US007228080B2

(12) United States Patent
Hamby et al.

(10) Patent No.: US 7,228,080 B2
(45) Date of Patent: Jun. 5, 2007

(54) SYSTEM FOR ACTIVE TONER CONCENTRATION TARGET ADJUSTMENTS AND METHOD TO MAINTAIN DEVELOPMENT PERFORMANCE

(75) Inventors: Eric S Hamby, Fairport, NY (US); Yongsoon Eun, Webster, NY (US); Eric M Gross, Rochester, NY (US); Lawrence Floyd, Rochester, NY (US); Joseph A Mastrandrea, Webster, NY (US)

(73) Assignee: Xerox Corporation, Stamford, CT (US)

( * ) Notice: Subject to any disclaimer, the term of this patent is extended or adjusted under 35 U.S.C. 154(b) by 154 days.

(21) Appl. No.: 11/169,715

(22) Filed: Jun. 30, 2005

(65) Prior Publication Data

US 2007/0003297 A1 Jan. 4, 2007

(51) Int. Cl.
*G03G 15/00* (2006.01)
*G03G 15/08* (2006.01)

(52) U.S. Cl. ..... 399/30; 399/27; 399/58

(58) Field of Classification Search ..... 399/49, 399/58, 59, 30, 27; 347/19; 358/406, 504, 358/296

See application file for complete search history.

(56) References Cited

U.S. PATENT DOCUMENTS

| | | | | |
|---|---|---|---|---|
| 5,471,313 | A | 11/1995 | Thieret et al. | 358/296 |
| 6,018,636 | A * | 1/2000 | Caruthers | 399/57 |
| 2004/0000339 | A1 | 1/2004 | Heiderman | 137/494 |
| 2004/0170442 | A1 | 9/2004 | Forbes et al. | 399/27 |
| 2004/0213593 | A1 * | 10/2004 | Brewington et al. | 399/27 |
| 2006/0216045 | A1 * | 9/2006 | Ramesh et al. | 399/27 |

* cited by examiner

*Primary Examiner*—Sophia S. Chen
(74) *Attorney, Agent, or Firm*—Oliff & Berridge, PLC

(57) ABSTRACT

A closed-loop toner concentration adjustment system extends xerographic process control performance with a system and method including a first controller to adjust toner concentration (TC) in a developer of the imaging device to alter a DMA level of the imaging device, the TC being adjusted based on a TC target value; a second controller to adjust an electrostatic development field to alter the DMA level; and an adjustment logic device to adjust the TC target value based on adjustments made to the electrostatic development field. The first controller outputs a dispense amount to the developer based on a difference between a measurement of the actual TC and the TC target value, thereby adjusting the TC based on the dispense amount to the developer. The second controller adjusts the electrostatic development field based on a difference between a measurement of the actual DMA level and a DMA target value. The adjustment logic monitors the adjustments made to the electrostatic development field to determine a trend, and adjusts the TC target value based on the trend.

20 Claims, 6 Drawing Sheets

SYSTEM FOR ACTIVE TONER CONCENTRATION TARGET ADJUSTMENTS AND METHOD TO MAINTAIN DEVELOPMENT PERFORMANCE

BACKGROUND

The exemplary embodiments relate generally to imaging or printing machines, and more particularly to controlling the concentration of toner in a development system of an electrophotographic imaging device to maintain a desired development performance. However, it is to be appreciated that the present exemplary embodiments will also find application in other types of devices where the concentration of toner and/or other materials used in the printing process is advantageously calibrated, monitored, or controlled.

In many related art printing and/or xerography systems, images are formed on paper and/or other medium using electrophotographic printing. A photoreceptive surface is electrostatically charged, and the image is transferred to the photoreceptive surface through selective exposure to light or other electromagnetic radiation. The light discharges the exposed areas of the photoreceptive surface to form an electrostatic charge pattern known in the art as a latent image. The latent image is developed by exposure to a developer material that selectively coats the charged surface areas.

A typical two-component developer includes toner particles and carrier beads. The carrier beads are usually several times larger than the toner particles. The toner particles triboelectrically bond to the larger, spherical carrier beads to form composite developer particles. In the vicinity of the electrostatically charged regions of the latent image, the toner particles are attracted away from the carrier beads and attach onto the photoreceptor due to the greater electrostatic attraction of the photoreceptor versus the triboelectric bonding to the carrier beads.

This developed latent image is referred to as the toner image. The toner image is transferred to the paper or other print medium using an electrostatic process to effectuate transfer of the toner particles from the toner image onto the paper. Finally, a fusing process employing heat and pressure permanently affixes the toner onto the paper or other print medium to form the final printed image.

SUMMARY

An important exemplary system parameter that affects the ability to provide consistently high quality electrophotographic printing is the control of the developer composition including the toner concentration. The toner concentration is typically defined as the ratio of the mass of the toner to the mass of the carrier in the developer. During printing, toner is gradually depleted, whereas the carrier beads do not transfer to the paper. Thus, the toner concentration in the developer decreases over time with usage.

Other system parameters also affect printer output. In order to address or solve problems associated with controlling the variables affecting the desired output from a printer, a controller of a xerographic device, such as a printer, may take a system-wide view and simultaneously control a plurality of factors affecting the printer. If one factor is controlled to correct for a variance, such as, for example, adding toner particles to the developer composition, the remaining factors are monitored and adjusted, if necessary, to ensure that the other variables of the printer are accurately maintained at predetermined levels.

For example, in development subsystems used in electrophotographic imaging devices, solid area toner mass density cannot be maintained on the photoreceptive surface under certain customer usage conditions. The problematic customer usage condition, known as a Low Area Coverage (LAC) condition, is characterized by sustained running at low area coverage (<3%), which is further exacerbated by operating in a low humidity environment. The root cause of the developability fall off is not fully understood at this time. Various hypotheses have been put forward such as material fines accumulation on the donor roll and "aged" toner resulting in increased toner adhesion to the donor roll and wires, among others. Though the cause of developability fall off is not well understood, its impact is readily apparent as prints become lighter as the developability fall off becomes more severe. The developability loss is monitored, for example, by a sensor that measures toner mass deposition on the photoreceptor. To compensate for the developability loss, an electrostatic development field or bias is adjusted. That is, to maintain developed toner under these conditions, an increase or decrease of voltage, for example, to the imaging device may be required.

This method may work for a relatively short period of time, for example, less than 5000 prints, because there is a limited range over which the bias can be moved. When this limit is reached, the machine for printing documents under the LAC condition shuts down, and the developer must be reconditioned.

Thus, when documents are continuously printed under LAC conditions, voltages of the printer, for example, may gradually be increased to compensate for the depletion of toner or changes in toner concentration. Over time, the voltages required for the printer to produce an acceptable print quality may reach a maximum value. That is, the total voltage may reach a limit where increased voltages may not be applied even though the depletion of toner continues. Thus, continually increasing printer voltages to compensate for depleted toner, for example, cannot sufficiently provide high quality prints with extended use of the printer.

The exemplary embodiments address or solve this problem by modifying or changing other variables in the printer to maintain a high quality print while not requiring the use of a maximum available voltage of the printer. That is, the exemplary embodiments include using more than one control variable to monitor and ensure high quality image prints. For example, toner concentration level also influences development. A controller monitoring toner concentration level may, as discussed above, increase the toner concentration level by having a small amount of fresh toner added to the printer. Thus, as print images are evaluated, to continue to produce a desired high quality print, toner concentration level may be increased instead of, or in addition to, changing the voltage level and/or modifying other variables in the printer.

In the related art, dispense, toner concentration, and an electrostatic development field are all factors that influence developed toner mass per unit area (DMA) levels. For example, in the related art, a toner concentration controller uses "dispense" to dispense replenisher (toner and/or carrier) to maintain a fixed toner concentration target. The toner concentration target is selected to provide latitude against both reload and background print quality defects. A developability controller, such as the one described in U.S. Pat. No. 5,471,313, uses electrostatic actuators, namely, a magnetic roll voltage (Vmag), a charge level on the photoreceptor (Vcharge), and a laser power (Vexpose) to maintain target DMA levels.

However, as discussed above, a key limitation of this related art approach has been demonstrated when the print engine is subjected to LAC stress conditions. Under LAC stress conditions, as discussed above, the Vmag actuator tends to become saturated causing the machine to shutdown. That is, the Vmag reaches a maximum limit whereby requests, for example, to increase the voltage to maintain system parameters, are not possible because the system is not capable of that level of output.

To avoid actuator saturation, machine interventions can be utilized to re-initialize the development process. As described in U.S. Patent Publication No. 20040170442, periodic purge of toner from the developer housing is a machine intervention used to maintain image quality. A purge routine is a dead cycle, from a document processing standpoint, in which a high area coverage equivalent of toner is developed and sent to a cleaner. No printing occurs during this dead cycle, so as not to interfere with print jobs. More particularly, during the purge cycle, the sump in the system is emptied of the toner by developing the toner onto a photoreceptor. The toner on the photoreceptor is then cleaned off the photoreceptor or printed onto paper. The sump is then refilled with fresh toner. However, purge type maintenance routines have several drawbacks. First, purge routines that require the machine to dead cycle reduce printing productivity since customer prints are not produced during the purge process. Second, and perhaps more importantly, purge routines increase the cost associated with printing. Cost increases occur because the toner used in the purging process is wasted in the sense that it is not used to produce prints for the customer and because the purge process results in additional service and/or maintenance for the cleaning subsystem.

In another related art, toner concentration control may be accomplished using a sensor that may take an indirect measure of the toner concentration. The sensor may respond to changes in the developer material that are not related to changes in the toner concentration. The sensor may respond to aging of the developer such that when the developer is run for a long period of time, the sensor reading will change even though the toner concentration remains constant. To address this issue, in the related art, corrections of measurements from the sensor are taken to account for aging effects. By turning off the corrections associated with toner aging effects, the system will tone-up under low area coverage conditions, which is beneficial for development.

Another approach sets a lower limit (greater than zero) on the dispense rate to ensure that the dispenser does not turn off. Under low area coverage conditions, this approach is beneficial for development but also results in increasing toner concentration levels.

A common feature shared by both of these approaches is that they are both open-loop. That is, the changes in toner concentration dispense are not in response to measurements of development performance. Because development performance depends on more than toner age, open-loop approaches may not be efficient in the sense that toner concentration dispense adjustments could be made even when they are not needed from a development viewpoint. That is, for example, for the same toner age, development has been shown to be vastly different depending on humidity in the housing.

To address the decrease in toner concentration over time, as well as the problems discussed above and other problems, the exemplary embodiments provide a closed-loop control scheme to mitigate print quality degradation when printing under LAC conditions. More specifically, the exemplary embodiments include controlled addition of fresh toner as a response to bias adjustment, even if a toner sensor indicates that the toner concentration is acceptable. The controlled addition of fresh toner, to an upper limit, may allow the bias control to work for an extended period, such as, about ten times longer, or more, for example. However, at the end of a long run, when the toner concentration is high, the toner concentration may need to be reduced to its central operating conditions without changing developability. The range of acceptable or desired toner concentration may be pre-determined depending upon the system, machine, and/or operating conditions. A high and/or a low value for the toner concentration may also be determined by the reload and background print quality defects.

More specifically, the exemplary embodiments provide a closed-loop toner concentration adjustment strategy to extend xerographic process control performance by monitoring the electrostatic development field and adjusting a toner concentration target value based on trends of the electrostatic development field. For example, the bias voltage applied to a magnetic development roll (Vmag) may change over time to maintain the target DMA, and this change may be taken as a measure of developability. Furthermore, changes in Vmag may be monitored to determine a trend, and the toner concentration target may be adjusted based on this trend to balance the load between the electrostatic actuators and the toner concentration level in the development housing. In particular, when Vmag rises, for example, above a certain level for a certain period of time, the toner concentration target is adjusted within a range, which then has the effect of temporarily reducing the Vmag level required to achieve the target DMA. Adjusting the toner concentration target in this manner significantly delays the time until the electrostatic actuators becoming saturated. Furthermore, because the toner concentration target is adjusted according to a closed-loop strategy, the system does not tone-up unnecessarily.

In an exemplary embodiment, a method for enhancing performance of an imaging device includes adjusting toner concentration in a developer to alter a DMA level of the imaging device, the toner concentration being adjusted based on a toner concentration target value; adjusting an electrostatic development field to alter the DMA level; and adjusting the toner concentration target value based on adjustments made to the electrostatic development field.

The method for enhancing performance of the imaging device may further include measuring the toner concentration in the imaging device, comparing a toner concentration measurement with the toner concentration target value, and outputting a dispense amount to a developer based on a difference between the toner concentration measurement and the toner concentration target value. The adjusting of the toner concentration may be based on the dispense amount to the developer.

The method for enhancing performance of the imaging device may further include measuring the DMA level in the imaging device and comparing a DMA level measurement with a DMA target value. The adjusting of the electrostatic development field to alter the DMA level may be based on a difference between the DMA measurement and DMA target value. The altering of the DMA level in the imaging device may be based on the adjustments made to the electrostatic development field.

The method for enhancing performance of the imaging device may further include monitoring the adjustments made to the electrostatic development field to determine a trend, and adjusting the toner concentration target value based on the trend.

In an exemplary embodiment, a system for enhancing performance of an imaging device, includes a first controller, a second controller, and an adjustment logic device. The first controller adjusts toner concentration in a developer of the imaging device to alter a DMA level of the imaging device, and the toner concentration is adjusted based on a toner concentration target value. The second controller adjusts an electrostatic development field to alter the DMA level. The adjustment logic device adjusts the toner concentration target value based on adjustments made to the electrostatic development field.

The system for enhancing performance of an imaging device further includes a sensor to measure the toner concentration in the imaging device, wherein the first controller compares a toner concentration measurement with the toner concentration target value, and outputs a dispense amount to the developer based on a difference between the toner concentration measurement and the toner concentration target value. The first controller adjusts the toner concentration based on the dispense amount to the developer.

The system for enhancing performance of an imaging device further includes a sensor to measure the DMA level in the imaging device. The second controller compares a DMA level measurement with a DMA target value and adjusts the electrostatic development field based on a difference between the DMA measurement and DMA target value. The second controller further alters the DMA level in the imaging device based on the adjustments made to the electrostatic development field.

The adjustment logic device monitors the adjustments made to the electrostatic development field to determine a trend, and adjusts the toner concentration target value based on the trend.

In an exemplary embodiment, a system for enhancing performance of an imaging device, includes means for adjusting toner concentration in a developer of the imaging device to alter a DMA level of the imaging device, the toner concentration being adjusted based on a toner concentration target value; means for adjusting an electrostatic development field to alter the DMA level; and means for adjusting the toner concentration target value based on adjustments made to the electrostatic development field.

DETAILED DESCRIPTION OF EMBODIMENTS

The exemplary embodiments provide an active toner concentration adjustment strategy to help maintain developability despite the effects of disturbances, such as, for example, LAC stress conditions observed on printers or xerographic devices. For the active toner concentration adjustment strategy, a toner concentration target is used as a slow development actuator and the traditional electrostatic actuators (e.g., Vmag, Vcharge, and Vexpose) are used as fast actuators. Developability is monitored via the electrostatic development field required to achieve target mass and to gradually adjust the toner concentration target to help reduce the load on the electrostatic actuators. A benefit in this approach is that it reduces machine shutdown rate for maintenance by delaying the saturation of the electrostatic actuators. This approach is easily implemented using existing known hardware.

A general description of a process that may be applied to any two-component development technology (e.g., hybrid scavengeless development (HSD), semi-conductive magnetic brush development (SCMB), etc) is provided below. According to the exemplary embodiments, in addition to an electrostatic image development device employing any two-component development technology, any suitable electrostatic image development device may be used.

Figure 1:
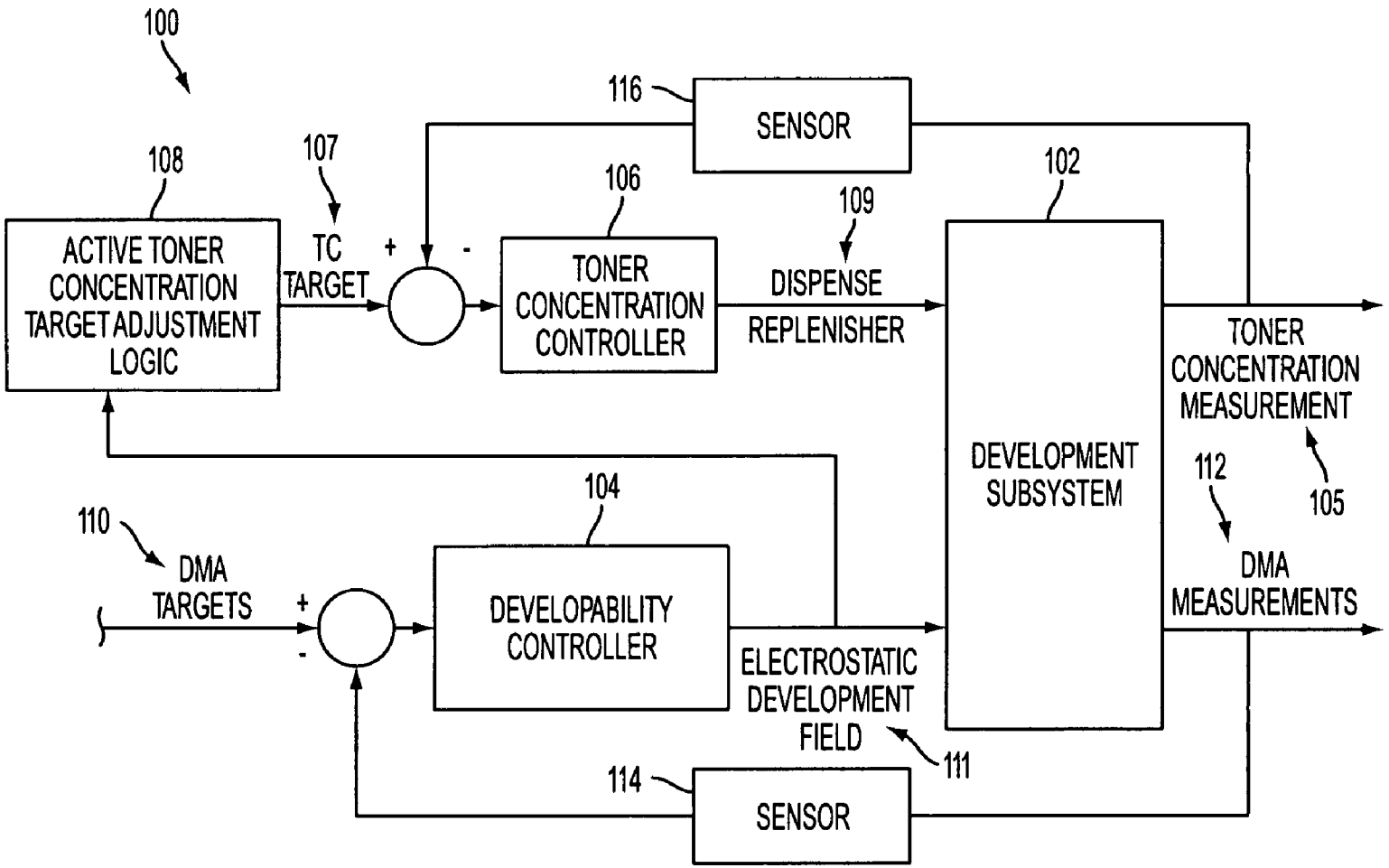
FIG. 1 is a block diagram schematic of an active toner concentration target adjustment strategy in an exemplary embodiment.
Figure 2:
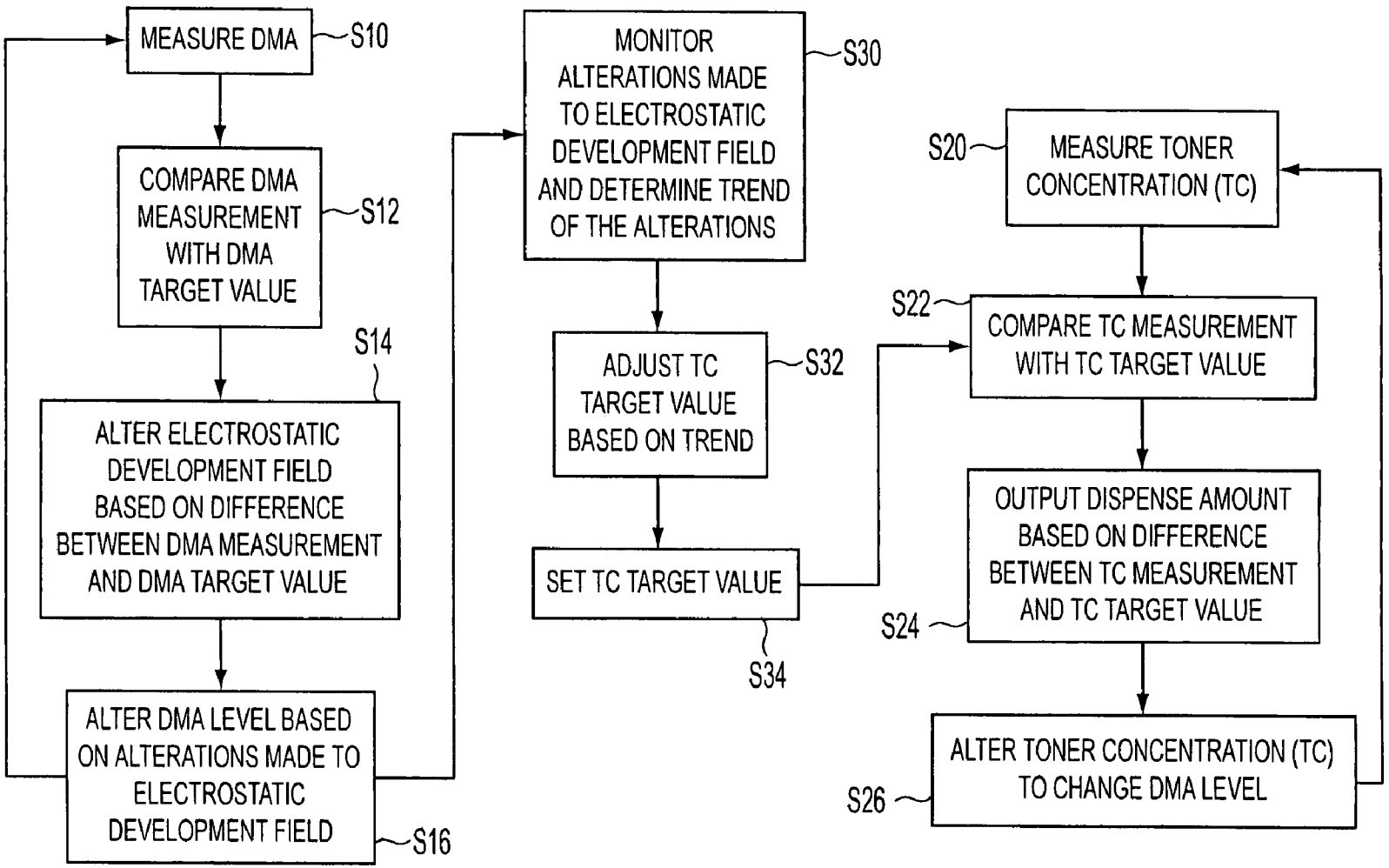
FIG. 2 is a flowchart of the active toner concentration target adjustment strategy in an exemplary embodiment.

With reference to FIG. 1, a block diagram of a system under active toner concentration target adjustment strategy is illustrated. With reference to FIG. 2, a method of enhancing performance of an imaging device with the system 100 is illustrated. The system 100 includes a development subsystem 102, developability controller 104, toner concentration controller 106, and an active toner concentration target adjustment logic 108. A sensor 114 measures a current DMA level, as shown at step S10. The measured DMA level 112 is compared to a target DMA level 110, as shown at step S12. The developability controller 104 takes a difference between the DMA target level 110 and an actual DMA measurement 112 as input and updates the electrostatic actuators to maintain the DMA target level 110, as shown at steps S14 and S16.

A sensor 116 measures current toner concentration level, as shown at step S20. The measured toner concentration level 105 is compared to a toner concentration target value 107, as shown at step S22. The toner concentration controller 106 takes the difference between the measured toner concentration 105 and the toner concentration target value 107 (i.e., toner concentration error) as input, and dispenses replenisher 109 (i.e., toner particles and/or carrier), as shown at step S24, to maintain the toner concentration at its target value. Thus, the toner concentration may be altered to affect the DMA level of the system, as shown at step S26.

The active toner concentration target adjustment logic 108 monitors an electrostatic development field 111, which has been altered based on the changes made to the electrostatic actuators, to determine a trend of the alterations made, as shown at step S30. The active toner concentration target adjustment logic 108 adjusts the toner concentration target value 107 based on this trend, as shown at step S32. A new toner concentration target value 107 is set as shown as step S34, and the above-described closed loop system may continue to monitor and change parameters to extend and enhance performance of an imaging device.

Accordingly, toner concentration may be adjusted, within an acceptable range, in order not to saturate the actuators used to set the electrostatic development field required to achieve target DMA. Specifically, as the developability gradually degrades due to low throughput, low Rh, and the like, a larger, in magnitude, Vmag, for example, may be required to achieve the target DMA. Increasing toner concentration by dispensing fresh toner can mitigate this degradation for a period of time and thus enable longer machine operation.

Changes in toner concentration are thus commanded in response to a change in developability, as measured by trends in the electrostatic development field. That is, the electrostatic development field may be a control variable and the trend is a measure of how the electrostatic development field responds overtime under a certain set of printing conditions. Thus, the system 100 is active since it adjusts the toner concentration according to a machine state observed through the electrostatic development field.

More specifically, with respect to the monitoring of the electrostatic development field, if the absolute value of Vmag, for example, rises above a given threshold more than "N" times, then the toner concentration target may be increased by a certain amount. However, the toner concentration does not increase immediately after the absolute value of Vmag rises above the threshold. This discourages or prevents the system from increasing the toner concentration due to the effect of measurement noise rather than developability degradations.

With respect to monitoring the DMA level, if the toner concentration target is outside of a given range, then the current toner concentration target value may be maintained. If the toner concentration target is not outside of a given range, then after waiting for "M" electrostatic development field measurements, the electrostatic development field may be monitored. ("M" being a pre-determined number of measurements.) This is to discourage or prevent consecutive toner concentration increments that may occur due to a delay for toner concentration target adjustments to take effect. Finally, the current toner concentration target value may be maintained.

Other reasonable algorithms may be developed based upon a further understanding of development system behavior. For example, if the magnitude of Vmag is "small" for a period of time, the toner concentration may be reduced to provide additional leeway for when the system may demand toner concentration target increases. A specific example of extending performance under LAC conditions is provided below.

EXAMPLE

According to this example, an active toner concentration target adjustment strategy may be applied to the problem of extending process control performance for hybrid scavengeless development (HSD) under LAC stress conditions. All results shown below were generated using a specific xerographic printing device; however, the concepts are generalized to other fixtures and/or two-component development technologies (i.e., SCMB technologies may also be used).

The sample printing device includes a single HSD housing (i.e., monochrome) and is only capable of solid area development. Solid area patches of toner are developed onto a receiver belt and are subsequently removed by a cleaning subsystem. There are no charging, exposure, or transfer subsystems on the printing device. Closed-loop process controls include toner concentration control and DMA control. For closed-loop toner concentration control, toner concentration is measured in-situ and in real-time using an optical toner concentration sensor positioned to take measurements from the magnetic roll. At the measurement sample times, the difference between the measured toner concentration value and the target toner concentration is fed to a standard proportional-integral (PI) controller, which then updates the dispenser commands. For closed-loop DMA control, an enhanced toner area coverage (ETAC) sensor is used to measure the developed patches in-situ and in real-time. At the measurement sample times, the difference between the measured DMA value and the target DMA is fed to a standard proportional-integral (PI) controller, which then updates Vmag actuator commands.

The experimental results described herein were generated on the sample printing device described above. The sample printing device was operated under a stress condition resembling LAC conditions: the area coverage was 2% and the environmental conditions surrounding the fixture were approximately 77 F and 10% Rh. Results of the active toner concentration target adjustment approach were compared to the baseline case characterized by closed-loop DMA control using PI control and closed-loop toner concentration control using PI control with a fixed toner concentration target. Prior to all experiments, the sample printing device was initialized to a given state. Two key performance metrics used in the experiments were the time until Vmag reached a predetermined limit and the DMA tracking performance.

Figure 3:
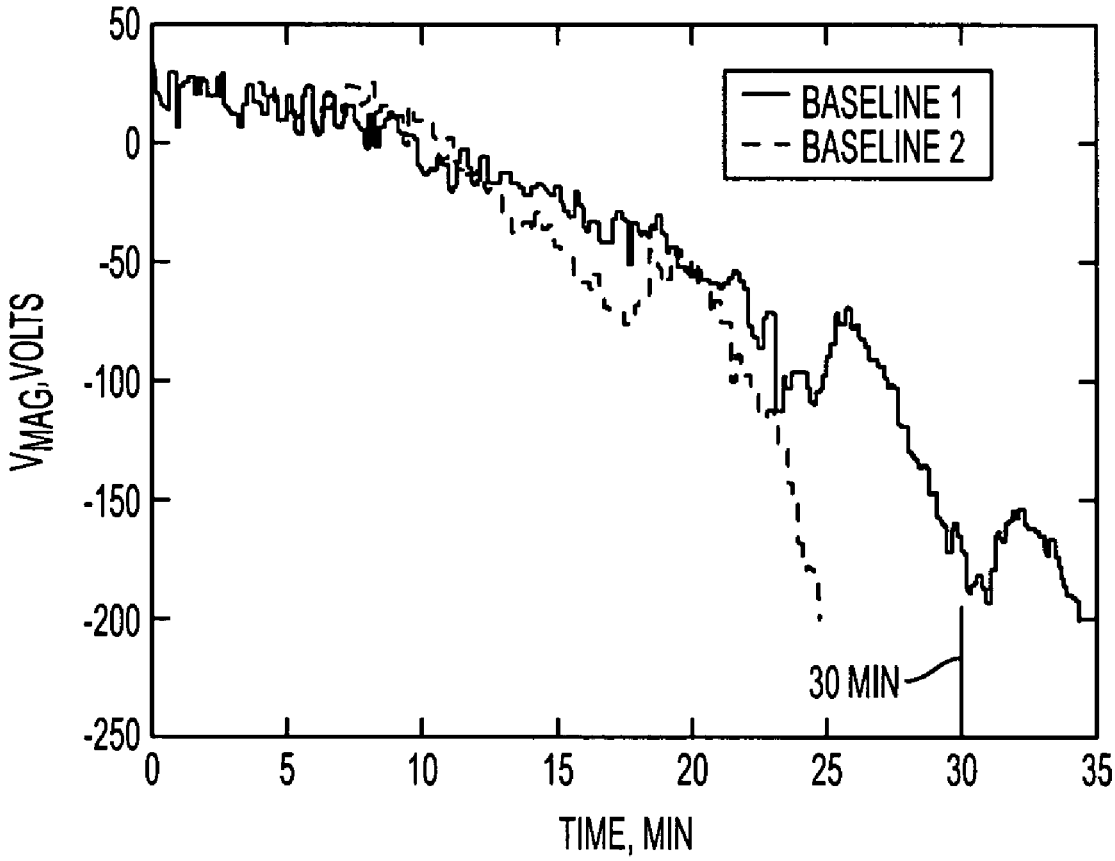
FIG. 3 is a chart illustrating typical Vmag responses under baseline conditions in an exemplary embodiment.
Figure 4:
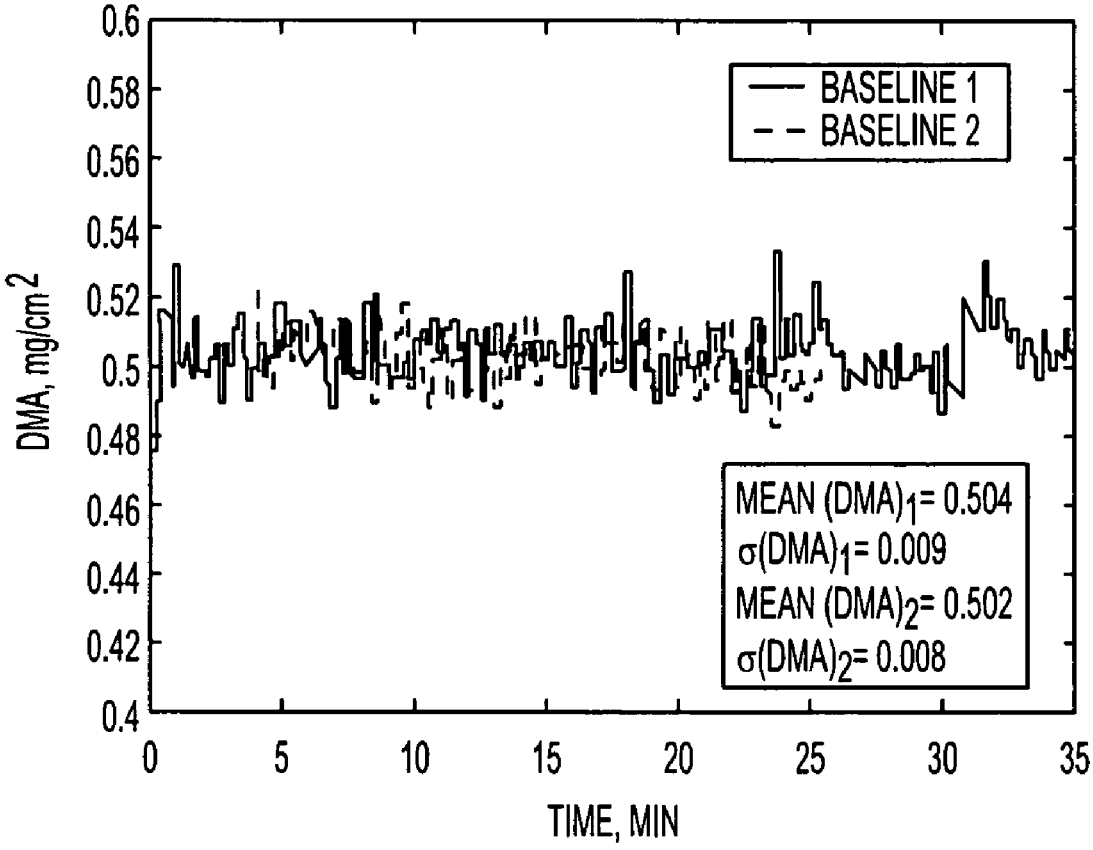
FIG. 4 is a chart illustrating typical DMA responses under baseline conditions in an exemplary embodiment.
Figure 5:
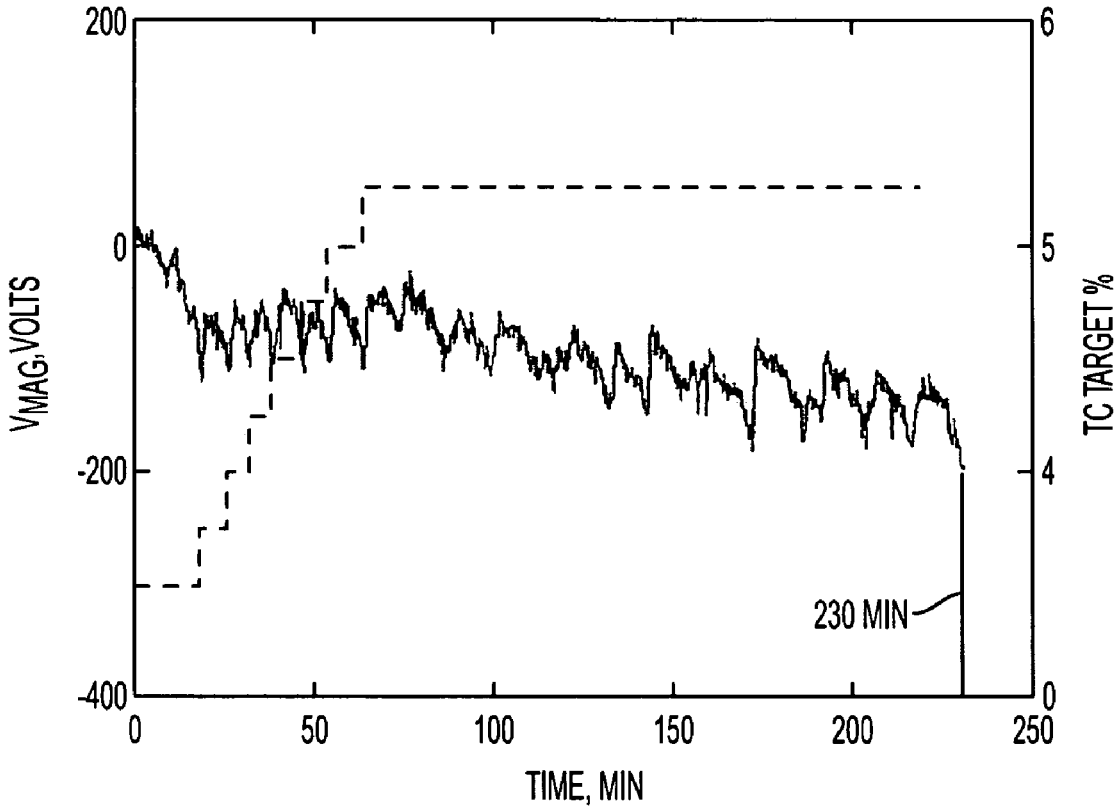
FIG. 5 is a chart illustrating typical Vmag and toner concentration target responses when applying the active toner concentration target adjustment strategy under baseline conditions in an exemplary embodiment.

FIG. 3 shows examples of Vmag actuator responses under baseline conditions (toner concentration fixed at a given value). Typically, Vmag reaches the given threshold in about 30 minutes under baseline conditions. The corresponding solid area DMA plots are shown in FIG. 4.

Where the active toner concentration target adjustment strategy is applied to the printing device operating under baseline conditions, the toner concentration target range was set between a lower limit and an upper limit. The Vmag level for triggering a toner concentration target adjustment was set at a given level and the toner concentration target step size was set at a fixed value less than 1% toner concentration. FIG. 5 illustrates both the Vmag and the toner concentration target responses. As shown in FIG. 5, the time to reach the Vmag threshold is 230 minutes, which represents an enhancement of about seven times an improvement over the baseline performance.

Figure 6:
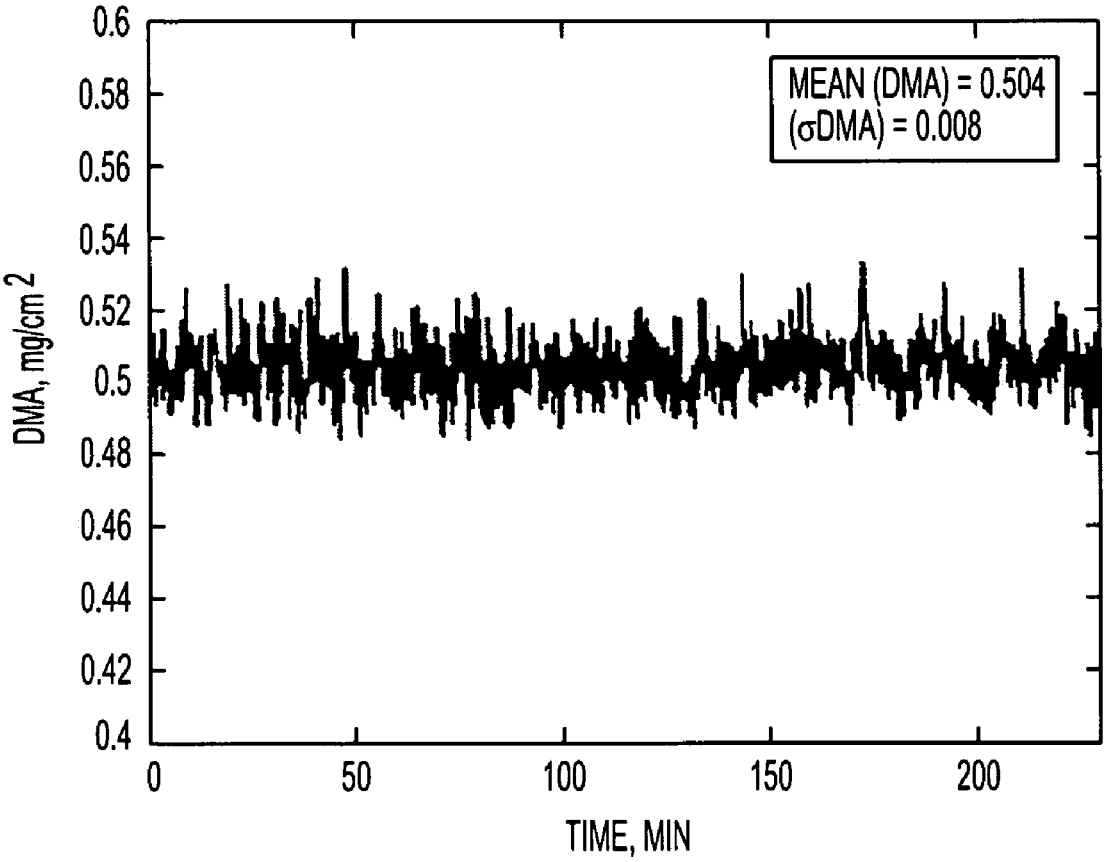
FIG. 6 is a chart illustrating typical DMA responses when applying an active toner concentration target adjustment strategy under baseline conditions in an exemplary embodiment.

FIG. 6 illustrates the corresponding DMA response under the active toner concentration target adjustment strategy. Comparing the mean and standard deviation of the DMA responses shown in FIGS. 3 and 5, reveals that the DMA tracking performance is not adversely affected by the active toner concentration target adjustment strategy. These and other benefits are a result of the exemplary embodiments discussed herein.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for enhancing performance of an imaging device, comprising:

adjusting toner concentration in a developer to alter a developed toner mass per unit area (DMA) level of the imaging device, the toner concentration being adjusted based on a toner concentration target value;

adjusting an electrostatic development field to alter the DMA level; and adjusting the toner concentration target value based on adjustments made to the electrostatic development field.

2. The method of claim 1, further comprising:

measuring the toner concentration in the imaging device.

3. The method of claim 2, further comprising:

comparing a toner concentration measurement with the toner concentration target value; and outputting a dispense amount to a developer based on a difference between the toner concentration measurement and the toner concentration target value.

4. The method of claim 3, wherein the adjusting of the toner concentration is based on the dispense amount to the developer.

5. The method of claim 1, further comprising:

measuring the DMA level in the imaging device.

6. The method of claim 5, further comprising:

comparing a DMA level measurement with a DMA target value.

7. The method of claim 6, wherein the adjusting of the electrostatic development field to alter the DMA level is based on a difference between the DMA measurement and DMA target value.

8. The method of claim 7, further comprising:

altering the DMA level in the imaging device based on the adjustments made to the electrostatic development field.

9. The method of claim 8, further comprising:

monitoring the adjustments made to the electrostatic development field to determine a trend; and adjusting the toner concentration target value based on the trend.

10. A system for enhancing performance of an imaging device, comprising:

a first controller to adjust toner concentration in a developer to alter a developed toner mass per unit area (DMA) level of the imaging device, the toner concentration being adjusted based on a toner concentration target value;

a second controller to adjust an electrostatic development field to alter the DMA level; and an adjustment logic to adjust the toner concentration target value based on adjustments made to the electrostatic development field.

11. The system of claim 10, wherein the first controller measures the toner concentration in the imaging device.

12. The system of claim 11, further comprising:

a developer, wherein the first controller compares a toner concentration measurement with the toner concentration target value, and outputs a dispense amount to the developer based on a difference between the toner concentration measurement and the toner concentration target value.

13. The system of claim 12, wherein the first controller adjusts the toner concentration based on the dispense amount to the developer.

14. The system of claim 10, wherein the second controller measures the DMA level in the imaging device.

15. The system of claim 14, wherein the second controller compares a DMA level measurement with a DMA target value.

16. The system of claim 15, wherein the second controller adjusts the electrostatic development field based on a difference between the DMA measurement and DMA target value.

17. The system of claim 16, wherein the second controller alters the DMA level in the imaging device based on the adjustments made to the electrostatic development field.

18. The system of claim 17, wherein the adjustment logic monitors the adjustments made to the electrostatic development field to determine a trend, and adjusts the toner concentration target value based on the trend.

19. A system for enhancing performance of an imaging device, comprising:

a means for adjusting toner concentration in a developer to alter a developed toner mass per unit area (DMA) level of the imaging device, the toner concentration being adjusted based on a toner concentration target value;

a means for adjusting an electrostatic development field to alter the DMA level; and a means for adjusting the toner concentration target value based on adjustments made to the electrostatic development field.

20. A xerographic device including the system of claim 19.

* * * * *